United States Patent [19]

Fidler, Jr.

[11] Patent Number: 4,569,362

[45] Date of Patent: Feb. 11, 1986

[54] FLEXIBLE FRAME AND TENT

[76] Inventor: Raymond E. Fidler, Jr., 20 N. Tower, Oak Brook, Ill. 60521

[21] Appl. No.: 657,939

[22] Filed: Oct. 5, 1984

[51] Int. Cl.[4] ..... A45F 1/00

[52] U.S. Cl. ..... 135/104; 135/102; 135/105; 135/DIG. 9

[58] Field of Search ..... 135/101, 102, 104, 105, 135/106, 109, 87, 900, 119, 120, 110, 111, DIG. 9

[56] References Cited

U.S. PATENT DOCUMENTS

| | | | |
|---|---|---|---|
| 912,184 | 2/1909 | Scott | 135/102 X |
| 2,167,219 | 7/1939 | Sankey | 135/120 X |
| 4,494,558 | 1/1985 | Fidler | 135/102 |

FOREIGN PATENT DOCUMENTS

| | | | |
|---|---|---|---|
| 494925 | 11/1938 | United Kingdom | 135/102 |

*Primary Examiner*—Robert A. Hafer
*Assistant Examiner*—D. Neal Muir

[57] ABSTRACT

A frame including a flexible resilient base ring having a floor covering removably attached and a flexible resilient top ring having a top covering removably attached. The top ring includes a pair of diametrically opposing ferrule connectors for attaching the top ring around the outside of a flexible resilient arched member. The arched frame member has opposing ends engaged to a pair of radially pivotable yokes positioned at diametrically opposing positions on the base ring and a side covering is removably attached between the top and base rings. Erection of the frame includes partially overlying the top ring on the base ring, engaging one end of the arched frame member to one yoke, causing the arched frame member to flex into the arched configuration and engaging the second end of the arched frame member to the second yoke.

8 Claims, 7 Drawing Figures

FLEXIBLE FRAME AND TENT

BACKGROUND OF THE INVENTION

This invention relates to collapsible frames for use with an enclosure such as a tent. More particularly, the invention relates to improvements to the frame and enclosure disclosed in my co-pending U.S. application Ser. No. 427,956, now U.S. Pat. No. 4,494,558 for Enclosure and Frame Therefore. I have found that by incorporating the improvements disclosed herein, a frame particularly adapted for use as a tent that is easy to erect and exhibits excellent resistance to collapse due to, for example, high winds is achieved.

SUMMARY OF THE INVENTION

Accordingly, the present invention provides for two flexible, resilient generally circular rings one of which is a base ring that rests on the ground and to which a floor covering is removably attached. The second ring is an upper ring attached at diametrically opposing locations thereon to opposite positions on the outside of an upright, flexible, resilient arch member.

According to a preferred aspect of the invention, the upper ring is provided with two ferrule connectors that slidably receive the arch member therein providing the attachment of the upper ring around the outside of the arch member. The base ring is provided with a pair of opposing, radially pivotable yokes to which the lower ends of the arch frame member are removably attached. A top covering is removably attached to both the upper ring and to the arch frame member. Preferably, the attachment of the top covering to the arch frame member provides for relative slidable motion between the arch frame member and the top covering attachment.

According to another feature of the invention, the pivotable yokes and provision for slidable motion of the arch frame member within the ferrule connectors and relative to the top covering attachment provides for a novel method of erecting the frame. The top ring with the top covering attached is partially overlaid the bottom ring with the floor covering attached. The arch frame member is positioned through the respective ferrules and top covering attachments with one end engaged to one of the pivotable yokes. The frame is erected by pushing on the free end of the arch frame member in a generally axial direction causing the arch frame member to flex to the arched position. With the top ring and top covering raised, the free end of the arch frame member is engaged to the second yoke.

A still further feature of the invention provides for a two piece sidewall covering removably attached to the top and bottom coverings with the respective sidewall pieces being removably attached together in end-to-end relationship.

In accordance with a still further important feature of the invention, stabilizing members, preferably in the form of two flexible, resilient tension rings, are secured between the top and base rings at diametrically opposing positions on the respective rings and maintain the structural integrity of the frame when subjected to large wind loads.

BRIEF DESCRIPTION OF THE DRAWINGS

The invention will be better understood after reading the following detailed description in connection with the accompanying drawings wherein.

DETAILED DESCRIPTION OF THE PREFERRED EMBODIMENT

Figure 1:
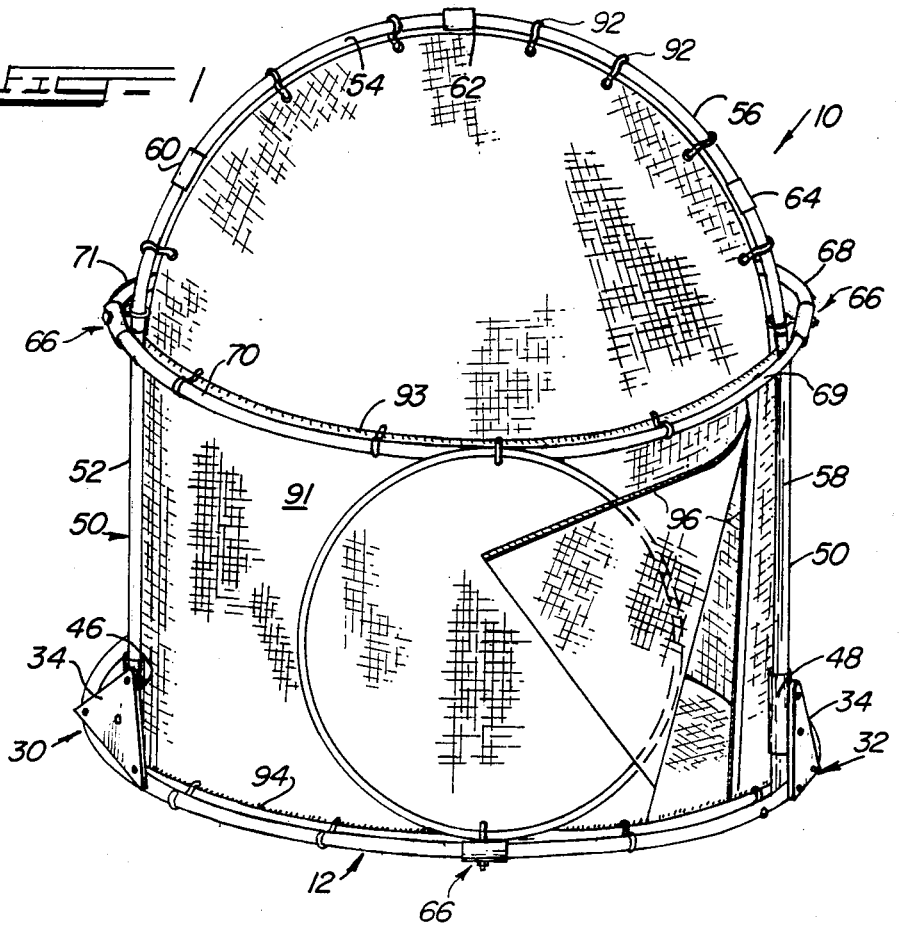
FIG. 1 is a perspective view of a tent embodying the present invention.
Figure 4:
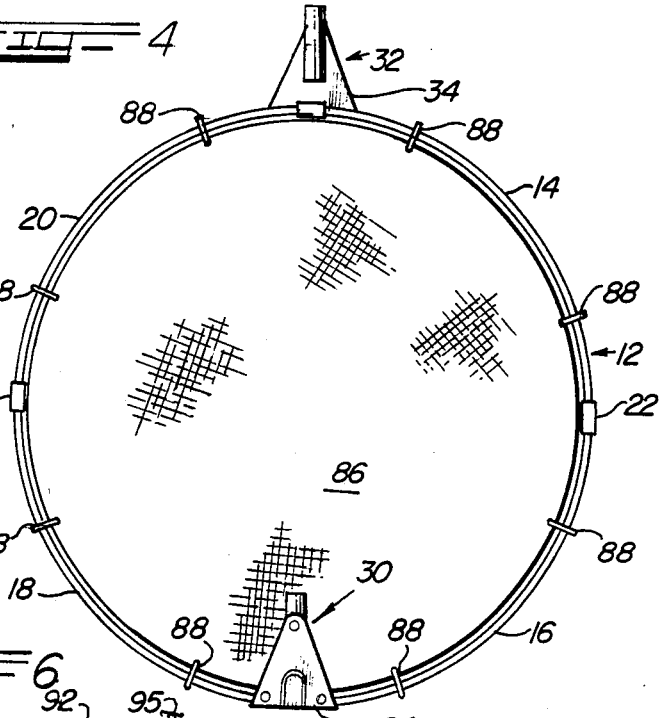
FIG. 4 is a plan view of the floor covering attached to the base ring.

Shown in FIG. 1 is a tent 10 which is comprised of a frame structure including a base ring 12, shown best in FIG. 4, which is made up of a plurality of elongated flexible resilient members such as tubes or rods 14, 16, 18, 20 attached together in end-to-end relationship. In the embodiment shown, the base ring 12 is comprised of four elongated members connected together by sleeves 22, 24, 26, 28. More or fewer elongated members can be used with the number generally depending on the diameter of the base ring and the flexibility of the base ring material. If desired, a single elongated member can be used having its ends connected together by a single sleeve. The number of members shown is therefore representative only, and the invention is not to be considered limited to the exact number of members shown.

Figure 3:
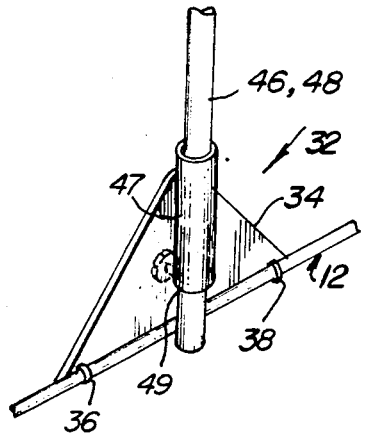
FIG. 3 is a perspective view of a yoke assembly showing details of construction.

A pair of yokes 30, 32 are attached to the base ring 12 at diametrically opposing locations on the base ring. The yokes 30, 32 each include a plate 34 and preferably a pair of fasteners 36, 38 that provide for radial pivotable motion of the plate about the base ring. Each fastener 36, 38 is an eyebolt 39 such as that shown in FIG. 2 for use with ferrule connectors described below. The eyebolt 39 includes a threaded stud portion 40 that passes through a hole in the plate 34 and is secured by a nut, not visible in FIG. 3, similar to the nut 35 shown in FIG. 2. The fastener also includes a circular eye portion 44 having an inside diameter slightly larger than the outside diameter of the elongated members of the base ring. The base ring 12 passes loosely through the eyes of the fasteners 36, 38 allowing the yokes to pivot about the elongated member radially with respect to the base ring. Other fasteners that provide for radial pivotal motion of the yokes are contemplated to be within the scope of the invention. For example, a pair of U-bolts fastened to the yoke plate and surrounding the base ring member can be used in place of the eyebolts shown.

Tubular sleeve members 46, 48 are fastened to each yoke plate with a pair of eyebolts 47, 49. The sleeves 46, 48 each have an inner diameter slightly larger than the outside diameter of the lower ends of an arch member 50. The arch member 50 is an elongated flexible resilient rod or tube-like member which naturally assumes a straight configuration. The opposing ends of the arch frame member are respectively inserted into the sleeves 46, 48 which cause the elongated member to flex and assume the arched configuration when the frame is erected. Alternatively, the arch frame member can be made up of a plurality of elongated members, such as 52, 54, 56, 58 in FIG. 1, connected together in end-to-end relationship by sleeves 60, 62, 64. A multiple piece construction provides for shorter members and a more compact assembly to handle when the frame is disassembled, while a one piece ring and arch member construction provides for substantially fewer pieces that must be handled and faster assembly. Both constructions have their own advantages and both are contemplated to be included within the scope of the present invention.

Figure 2:
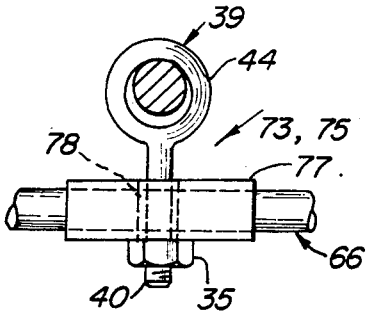
FIG. 2 is a plan view of a ferrule connector showing details of construction.

A second ring in the form of a top ring 66 is located above the base ring around the outside of the arch frame member 50. Locating the top ring around the outside rather than the inside of the arch frame member is an important feature in that during erection of the frame as set out below, the top ring rises above the base ring more easily as the elongated arch frame member is flexed into the arched configuration. In the embodiment shown, the top ring 66 is made up of a plurality of elongated flexible resilient members 68, 69, 70, 71 connected together in end-to-end relationship by a pair of sleeves 72, 74 and two ferrule connectors 73, 75. As shown in FIG. 2, ferrule connectors 73, 75 each include a sleeve portion 77 similar to the sleeves that connect the base ring members and arch frame members together. However, the sleeve 77 of the ferrule connector is provided with the eyebolt 39 similar to those used to fasten the base ring to the respective yokes as hereinabove set out. The sleeve 77 includes a transverse clearance hole 78 into which the threaded stud portion 40 of the eyebolt 39 is inserted. The eyebolt is secured to the sleeve by the nut 35. The eyebolt of the ferrule connector also includes a circular opening that has a diameter slightly larger than the diameter of the arch frame member which allows the arch frame member to slide within the eyebolt relative to the top ring during erection and dismantling of the frame.

As shown in FIG. 4, a fabric-like floor covering 86 is provided. The floor covering 86 is attached to the base ring by a plurality of hooks, for example S-shaped hooks 88. The hooks 88 are equally spaced around the base ring and engage an equal number of eyelets 89 located around the perimeter of the floor covering.

Figure 6:
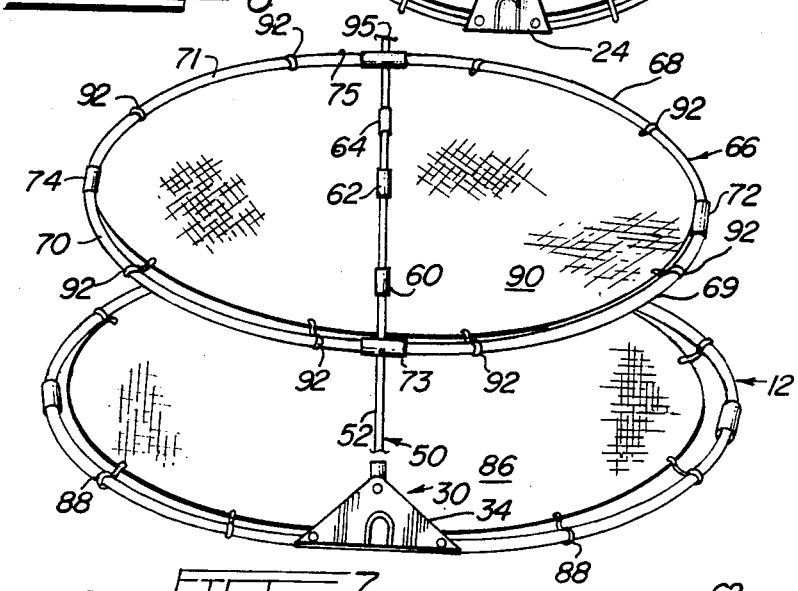
FIG. 6 is a plan view of the assembled top and base rings in preparation for erecting the tent.

As shown in FIG. 6, a separate fabric-like top covering 90 is also provided. The top covering 90 is attached to the top ring also by a plurality of hooks 92. The hooks 92 are equally spaced around the top ring and engage eyelets located around the perimeter of top covering. Similar hooks are positioned on the arch frame member and engage additional eyelets or attachment straps positioned across the top covering in line with the arch frame member. S-shaped hooks are representative of only one attachment means. For example, a plurality of fabric-like straps, not shown in the drawings, can be equally positioned around the perimeter of the base and top covering and made to encircle the respective rings and arch member. Other attachments can be readily devised by those skilled in the art, however hooks are preferred because they are strong as well as easy and fast to assemble.

Referring to FIG. 1, there is shown a fabric-like sidewall 91 which can be made either of a one or two piece construction. The perimeter of the top and bottom coverings are each provided with one row of zipper teeth, and the sidewall top edge is provided with a complementary row of zipper teeth that cooperate with the teeth on the top covering to effect a zipper connection 93. Correspondingly, the sidewall bottom edge is also provided with a row of zipper teeth that cooperate with complementary zipper teeth on the floor covering to effect a second zipper connection 94 between the floor and sidewall. The respective vertical ends of the sidewall are also provided with a separate zipper connection 96 to complete the enclosure. The vertical sidewall zipper connection 96 functions as a means of ingress and egress with the interior of the tent. Alternatively, the sidewall can include two sections attached in end-to-end relationship also by a zipper connection. It can be seen that the zipper connections allow the entire sidewall to be removed leaving a floor and top covering. If two sidewall sections are utilized, only one section might be removed leaving a partial enclosure. Or, all or a portion of the sidewall can be replaced with, for example, a sidewall panel of screen providing an enclosed screen tent. It can be appreciated that the multiple, removable sidewall construction provides for a very versatile multi-purpose enclosure.

ASSEMBLY

Referring to FIGS. 4–7, to assemble the tent, the base ring is assembled first, see FIG. 4, by inserting the respective elongated members into the respective sleeves and through the eyebolts of the yokes. The flexible members will normally assume a generally circular shape when connected together, and the yokes 30, 32 are positioned on the base ring at diametrically opposing positions. One of the yokes 30 is pivoted radially toward the center of the base ring and allowed to lie flat as shown in FIG. 4. The opposite yoke can be allowed to lie flat either outside or inside of the base ring as desired.

Figure 5:
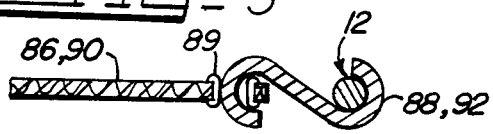
FIG. 5 is a cross-sectional view of one connection for attachment of the floor and top coverings to the base and top rings of the tent in FIG. 1.
Figure 7:
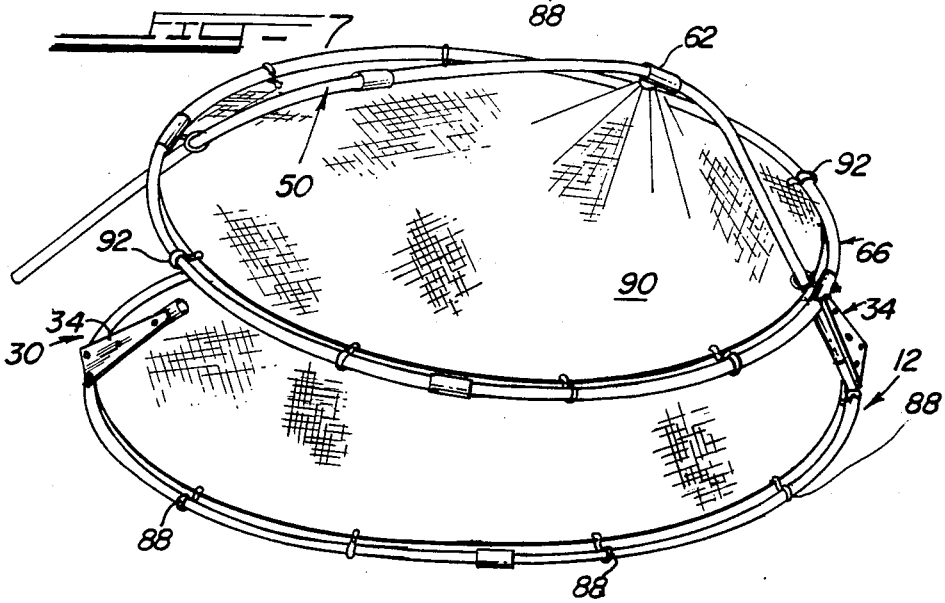
FIG. 7 is a perspective view of the tent being erected.

The floor covering is then attached to the base ring by engaging the hooks to the eyelets in the floor and to the base ring, as shown in FIG. 5. While not required, the base ring can be staked to the ground if desired. The tent does not require staking to be erected however, and this is a very important advantage particularly in terrain or surroundings where staking may be difficult if not impossible. Referring to FIG. 6, after assembly of the base ring and floor, the top ring is assembled by inserting the respective elongated members into the respective sleeves. Because the top ring members are also flexible and resilient, they will naturally assume a generally circular shape when assembled. The respective ferrule connectors 73, 75 are located at diametrically opposing positions on the top ring. The top covering is then attached to the top ring by engaging the hooks in the eyelets provided in the top cove perimeter and to the top ring. The top ring with the top cover attached is then partially overlaid the bottom ring and covering as, shown in FIG. 6, leaving the inwardly orientated yoke 30 exposed. The elongated arch member 50 is then passed under the top ring, over the top covering and through the respective openings in the eyebolts of the ferrule connectors. One end of the arch member is then inserted into the sleeve 46 of the inwardly orientated yoke. The top covering is then attached to the elongated frame member by engaging the respective hooks on the top covering to the arch member. As shown in FIGS. 6 and 7, the assembly is raised by grasping the free end 95 of the elongated arch member 50 and pushing generally axially on the arch member. This causes the arch member to slide within the ferrule connectors and flex into the arched configuration raising the top ring and covering over the base ring. The free end 95 of the arch member is then inserted into the other yoke sleeve 48, not visible in FIG. 7, but shown in FIG. 1, and erection of the tent frame is complete.

The assembly of the tent is completed by attaching the sidewall to the top and floor with the zipper connections. For added stability, such as, for example, if high winds are expected to be encountered, a pair of stabilizing rings, only one of which 96 is shown in FIG. 1, are lashed between the top and base rings preferably at diametrically opposing locations equally spaced from the ferrules and yokes. The stabilizing rings act to tension the top and base rings and maintain them in their normal spaced apart generally parallel relationship. To disassemble the tent, the assembly procedure is reversed by disengaging one end of the arch member from one of the yoke sleeves and allowing the tent to collapse to the flat position shown in FIG. 6. In this position the respective coverings and frame members can be disassembled.

The tent and frame described can be readily modified, and other embodiments of the invention can be readily devised by those skilled in the art having the benefit of the description and drawings given herein. Therefore, said other embodiments and modifications are to be considered within the scope of the appended claims.

What is claimed is:

1. A frame comprising:

a generally circular base ring including at least one flexible, resilient elongated member connected together in end-to-end relationship;

a pair of yokes mounted to said base ring at diametrically opposing positions on said base ring, said yokes being pivotable radially with respect to said base ring;

an upright arch member including at least one flexible, resilient elongated member having opposite free ends removably attached to said respective yokes;

a generally circular top ring including at least one flexible, resilient elongated member connected together in end-to-end relationship and being disposed around the outside of said arch member; and connector means connecting opposite positions on said arch member to diametrical opposing positions on said top ring.

2. A frame comprising:

a generally circular base ring including at least one flexible, resilient elongated member connected together in end-to-end relationship;

a pair of yokes mounted to said base ring at diametrically opposing positions on said base ring, said yokes being pivotable radially with respect to said base ring;

an upright arch member including at least one flexible, resilient elongated member having opposite free ends removably attached to said respective yokes;

a generally circular top ring including at least one flexible resilient elongated member connected together in end-to-end relationship and being disposed around the outside of said arch member; and connector means connecting opposite positions on said arch member to diametrically opposing positions on said top ring, said connector means including:

a pair of ferrules each including, a tubular sleeve having said top ring elongated member rotatably received therein;

a stud member protruding perpendicularly from said sleeve and including a clearance hole; and said arch member is slidably received in said clearance hole in each said stud.

3. The frame as defined in claim 2 further comprising:

stabilizer means for maintaining said top ring and said base ring in spaced apart substantially parallel relationship.

4. The frame as defined in claim 3 wherein said stabilizer means includes a pair of tension members, each tension member being attached between said top ring and said base ring.

5. The frame as defined in claim 4 wherein said tension members comprise:

a pair of flexible, resilient rings each having a diameter substantially equal to the space between said top ring and said bottom ring.

6. A tent comprising:

a generally circular base ring including at least one flexible, resilient elongated member connected together in end-to-end relationship;

a pair of yokes mounted to said base ring at diametrically opposing positions on said base ring, said yokes being pivotable radially with respect to said base ring;

an upright arch member including at least one flexible, resilient elongated member having opposite free ends removably attached to said respective yokes;

a generally circular top ring including at least one flexible, resilient elongated member connected together in end-to-end relationship and being disposed around the outside of said arch member;

connector means connecting opposite positions on said arch member to diametrically opposing positions on said top ring;

a fabric-like floor covering removably attached to said base ring;

a fabric-like top covering removably attached to said top ring and to said arch member; and a fabric-like side covering removably attached to said top covering at the perimeter of said top covering, said side covering depending from said top covering and removably attached to said floor covering at the perimeter of said floor covering, and the opposing ends of said side covering being removably attached together.

7. The frame as defined in claim 6 wherein said side covering is attached to said top covering and to said floor covering respectively by a pair of zippers and the opposing ends of said side covering are attached together by a third zipper.

8. The frame as defined in claim 6 wherein said side covering includes at least two sections removably attached together in end-to-end relationship.

* * * * *